US006251224B1

(12) United States Patent
Dong

(10) Patent No.: US 6,251,224 B1
(45) Date of Patent: Jun. 26, 2001

(54) BICOMPONENT MATS OF GLASS FIBERS AND PULP FIBERS AND THEIR METHOD OF MANUFACTURE

(75) Inventor: Daojie Dong, Westerville, OH (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 0 days.

(21) Appl. No.: 09/474,449

(22) Filed: Dec. 29, 1999

Related U.S. Application Data

(60) Provisional application No. 60/147,256, filed on Aug. 5, 1999.

(51) Int. Cl.[7] ..... D21H 13/40

(52) U.S. Cl. ..... 162/145; 162/156; 162/168.3; 162/183

(58) Field of Search ..... 162/145, 156, 162/135, 168.3, 183

(56) References Cited

U.S. PATENT DOCUMENTS

| | | | | |
|---|---|---|---|---|
| 3,012,929 | * | 12/1961 | Jackson | 162/145 |
| 3,135,590 | * | 6/1964 | Campbell et al. | 162/145 |
| 3,749,638 | * | 7/1973 | Renaud et al. | 162/145 |
| 4,160,159 | | 7/1979 | Kakukawa et al. . | |
| 4,609,431 | | 9/1986 | Grose et al. . | |
| 5,167,765 | | 12/1992 | Nielsen et al. . | |
| 5,393,379 | | 2/1995 | Parrinello . | |
| 5,580,459 | | 12/1996 | Powers et al. . | |
| 5,965,638 | * | 10/1999 | Heine | 524/13 |

FOREIGN PATENT DOCUMENTS

| | | |
|---|---|---|
| 004 833 | 10/1979 | (EP) . |
| 070164 A2 | 1/1983 | (EP) . |
| 311860 A2 | 4/1989 | (EP) . |
| 88/01319 | 2/1988 | (WO) . |
| 98/11299 | 3/1998 | (WO) . |
| 99/13154 | 3/1999 | (WO) . |

* cited by examiner

*Primary Examiner*—Peter Chin
(74) *Attorney, Agent, or Firm*—Inger H. Eckert

(57) ABSTRACT

The invention relates to a method of forming a bicomponent mat, the bicomponent mat which is formed from glass fibers and pulp fibers and methods of making a bicomponent mat. Initially in the method of forming a bicomponent mat, a pulp surface is treated with a cationic polymer in a pulp slurry. The next step involves using a surfactant to disperse glass fibers in a polyacrylamide (PAM)-based white water. The pulp slurry and the slurry of glass fibers are generally compatible and are combined to form a bicomponent furnish. The method has several advantages over conventional methods. First, conventional wet chop products typically cannot be used to form a bicomponent mat in a typical surfactant/PAM-based white water. Second, while some other fibers (such as glass fibers) may be used in the production of bicomponent mats in a typical PAM-based white water, the mat forming process is frequently interrupted and tends to produce very poor quality mats. Third, the mat forming of the invention process easily produces high quality bicomponent mats that are uniform and have a dense structure and low permeability. Finally, the method of the invention may be used to make a variety of wet chop products that are compatible with either softwood or hardwood fibers.

16 Claims, 7 Drawing Sheets

BICOMPONENT MATS OF GLASS FIBERS AND PULP FIBERS AND THEIR METHOD OF MANUFACTURE

CROSS-REFERENCE TO RELATED APPLICATION

This application is based on provisional application Ser. No. 60/147,256 filed Aug. 5, 1999, the contents of which are incorporated herein by reference.

TECHNICAL FIELD AND INDUSTRIAL APPLICABILITY OF THE INVENTION

This invention relates generally to bicomponent mats and their method of manufacture. In particular, the invention relates to a method of making a bi-component mat of glass fibers and pulp fibers using a pulp surface treatment and a compatible dispersion system and the mats formed by this method.

BACKGROUND OF THE INVENTION

The present invention relates to a fibrous mat and its method of manufacture. Several types of fibrous mats and their method of manufacture are known. For example, one conventional method of making a nonwoven fabric is known as a dry process, which involves the bonding of fibers by heat. European Patent Application No. 0 070 164 to Fakete et al. (Fakete) generally involves such a method. The fabric in Fakete relates to a blend of bicomponent fiber and natural or synthetic fiber. Fakete generally involves a low density, thermobonded, nonwoven fabric comprising a staple length polyester/polyethylene bicomponent fiber and a short length natural cellulose fiber. The thermal bonding is at a temperature sufficient to fuse the polyethylene component without fusing the polyester component, while the web is maintained under little or no compression.

U.S. Pat. No. 4,160,159 to Samejima (Samejima) generally involves an absorbent fabric containing wood pulp combined with short-length, heat fusible fibers. Although Samejima generally involves the use of the combination of bicomponent fibers and cellulose fibers, the disclosure is not directed to a wet lay application.

Some conventional processes use cellulosic fibers, such as wood pulp, as the sole fibrous component in a mat or sheet. However, sheets incorporating only cellulose fibers are often dimensionally unstable. Depending on the application, swelling will often occur in the sheet and in any subsequent laminated surface covering into which the sheet is incorporated. This swelling can result in the buckling of the laminated sheet such that the borders may curl, sometimes resulting in the delamination of the backing sheet from the surface coverings.

Recently, nonwoven textile fabrics have been manufactured through the use of wet forming techniques on conventional or modified paper making or similar machines. Such manufacturing techniques have much higher production rates and are also suitable for very short fibers such as wood pulp fiber. Unfortunately, difficulties are often encountered in the use of textile length fibers in such wet forming manufacturing techniques.

Several problems arise in attempting to incorporate a heat fusible fiber such as a bicomponent fiber into a wet lay fibrous web. Problems encountered in attempting to incorporate a heat fusible fiber such as a bicomponent fiber into a wet lay process include, for example, attaining uniform dispersion of the bicomponent fiber as well as attaining a thermally bonded web with sufficient strength such that the thermally bonded web is usable. It has been found in the past that bicomponent fibers containing a sheath of high density polyethylene (HDPE) and a core of polyester are difficult to uniformly disperse in wet lay solutions. When such dispersion of fibers were attained, fibrous webs produced therefrom were found to lack the desired strength.

Nonwoven textile fabrics are normally manufactured by laying down one or more fibrous layers or webs of textile length fibers by dry textile carding techniques which normally align the majority of the individual fibers more or less generally in the machine direction. The individual textile length fibers of these carded fibrous webs are then bonded by conventional bonding (heating) techniques, such as, by point pattern bonding, whereby a unitary, self-sustaining nonwoven textile fabric is obtained.

Conventional manufacturing techniques for nonwoven textile fabrics are relatively slow and manufacturing processes having greater production rates are desired. Dry textile carding and bonding techniques are normally applicable only to fibers having a textile cardable length of at least about ½ inch and preferably longer. Such techniques are not generally applicable to short fibers such as wood pulp fibers which have very short lengths from about ⅙ inch down to about 1/25 inch or less.

Another conventional thermally bonded fibrous wet laid web containing a specific bicomponent fiber is generally taught in U.S. Pat. No. 5,167,765 to Nielsen et al. The bicomponent fiber consists essentially of a first component consisting of polyester or polyamide and a second component consisting of linear low density polyethylene and grafted high density polyethylene grafted with maleic acid or maleic anhydride. The thermally bonded fibrous wet laid web may further include a matrix fiber selected from a group consisting of cellulose paper making fibers, cellulose acetate fibers, glass fibers, polyester fibers, ceramic fibers, metal fibers, mineral wool fibers, polyamide fibers, and other naturally occurring fibers.

In the previous processes of making wet laid webs or paper from fibers of whatever source, it is customary to suspend previously beaten fibers, or what is generally known as pulp, in an aqueous medium for delivery to a sheet-forming device, such as a Fourdrinier wire. This fiber containing aqueous dispersion is commonly referred to in the art as a furnish. One drawback at this stage of making wet laid fibrous webs is the tendency for the fibers to clump, coagulate or settle in the aqueous tank or container. This condition is generally referred to as flocculation. Flocculation causes a nonuniform distribution of fibers in the resulting paper product. Typically, the end product has a mottled, uneven appearance and has very poor physical properties as tear, burst, and tensile strength. Another problem in making wet laid fibrous webs is a tendency of the fibers to float to the surface of the furnish.

For the manufacture of fibrous wet laid webs from conventionally used fibers such as cellulose, methods are known for attaining uniform dispersion of the fibers and reducing and preventing the occurrence of flocculation. One of the more effective means has been to add a small amount of karaya gum to the fiber furnish. However, this has not proven entirely satisfactory. Other agents such as carboxymethyl cellulose or polyacrylamide have been used to attain the desired result of the cellulose in the furnish.

Fibrous wet laid webs may also be made from other natural or synthetic fibers in addition to wood cellulose paper-making fibers. A water furnish of the fibers is generally made with an associative thickener and a dispersant. The cellulose pulp is dispersed in water prior to adding the dispersant. A thickener is added in an amount in the range up to 150 pounds per ton of dry fiber making up the water furnish. Then natural and/or synthetic fibers are added and dispersed in the mixture. Finally, the dispersion of mixed fibers in the water is diluted to a desired consistency and dispensed onto the forming wire of a conventional paper-making machine. An anti-foam agent may be added to the dispersion to prevent foaming, if necessary, and a wetting agent may be employed to assist in wetting the fibers. A bonded fibrous web may be formed from the fiber furnish on a high speed conventional Fourdrinier paper making machine to produce a fibrous wet laid web.

In prior art wet lay processes using polyester fibers as the textile staple fibers, water-based binders are generally added to the process to insure adhesion between the cellulose fibers and the polyester fibers. Generally, from about 4% to about 35% binder material is employed. One of the problems encountered with a water based binder is the binder leaches out of the resultant web in such applications as filters. Also, the addition of binders increases cost and results in environmental problems. Furthermore, latex binders have a short shelf life and require special storage conditions. Also, the latex binders may be sensitive to the condition of the water employed.

Another known thermally bonded fibrous wet laid web includes specific bicomponent fibers so as to yield a thermally bonded web not only having increased strength, but also that has a greater web uniformity and is softer than a regular paper web. The web consists essentially of a bicomponent fiber comprising a first fiber component of polyester or polyamide, and a second component consisting essentially of a linear low density polyethylene (LLDPE), and grafted high density polyethylene, HDPE which has been grafted with maleic acid or maleic anhydride, thereby providing succinic acid or succinic anhydride groups grafted along with the HDPE polymer.

European Patent Application 0 311 860 generally involves a bicomponent fiber having a polyester or polyamide core and a sheath component consisting of a copolymer straight-chain low density polyethylene; and the bicomponent fiber can be formed into a web through the use of known methods of making nonwoven fabrics including wet laying. The copolymer polyethylene is defined as consisting of ethylene and at least one member selected from the class consisting of an unsaturated carboxylic acid, a derivative from said carboxylic acid and a carboxylic acid and a carboxylic acid anhydride.

Another conventional wet process uses a cationic dispersant in a polyacrylamide (PAM)-based white water. This process may be used to produce acceptable mats consisting only of glass fibers. However, a drawback of this process is that it generally does not consistently produce bicomponent mats including pulp fibers. When pulp fibers are added to the white water, the mats formed by the process have very low product qualities. Further, the mat forming process is frequently interrupted.

Another known bicomponent mat and method of forming the mat is generally suggested in PCT publication WO99/13154 to the Elk Corporation (Elk). Elk generally involves a bicomponent mat comprising fiberglass fibers and wood pulp.

There remains a need to develop a wet lay fibrous web including a suitable heat fusible bicomponent filament which will not only increase the strength of the web, but also avoid problems associated with adding binders.

SUMMARY OF THE INVENTION

The shortcomings of the prior art are overcome by the disclosed bicomponent mat and methods of forming a bicomponent mat. Generally, the bicomponent mat of the invention is formed from glass fibers and pulp fibers. The mats are generally formed by treating a pulp surface with a cationic polymer in a water slurry. The next step involves using a surfactant to disperse glass fibers in a polyacrylamide (PAM)-based white water. The pulp fiber slurry and the glass fiber slurry are compatible and are combined to form a bicomponent furnish.

The method of this invention has several advantages over conventional methods. First, conventional wet chop products typically cannot be used to form a bicomponent mat in a typical surfactant/PAM-based white water. Second, while glass fibers may be used in the production of bicomponent mats in a typical PAM-based white water, the mat forming process is frequently interrupted and produces very poor quality mats. Third, the mat of the invention forming process easily produces high quality bicomponent mats that are uniform and have a dense structure and low permeability. Finally, the method of the invention may be used to make a variety of wet chop products that are compatible with either softwood or hardwood fibers.

The method of this invention involves making a bicomponent mat of glass fibers and wood pulp comprising the steps of: forming a pulp slurry by mixing wood pulp, water, and a cationic polymer; forming a slurry of glass fibers by mixing together a dispersant, water, glass fiber, and a viscosity modifier; combining and mixing the pulp slurry and the slurry of fibers to form a wet mat; applying a binder to the wet mat; and removing any excess moisture and curing the binder.

DETAILED DESCRIPTION AND PREFERRED EMBODIMENTS OF THE INVENTION

Figure 1:
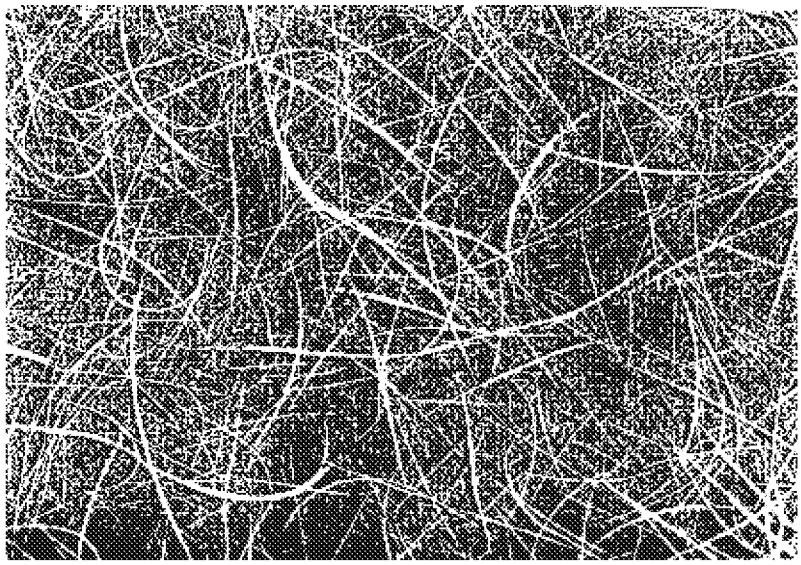
FIG. 1 is a photograph of a mat produced in Example 2.

A bicomponent mat and method of forming such a mat is described in detail below. Through the method of the invention improved bicomponent mats may be formed which exhibit advantageous properties as compared to conventional bicomponent mats. In particular, the mats of the invention are capable of exhibiting improved tear resistance, tensile strength and lower permeability. The mats of the invention may be in the form of a uniform web which may be coated depending upon the desired use. Due to the uniform nature of the web, it is possible to employ lower amounts of a coating, for example, a latex coating, to achieve equivalent coating properties as compared to conventional coated mats.

An objective of the disclosed method is to provide an improved wet process method for making bicomponent mats of glass fibers and pulp fibers. The bicomponent mat may be formed by handsheeting or pilot/commercial scale wet laid processes and includes glass fibers and pulp fibers. A wet laid process is advantageous for forming a generally uniform web, and is particularly advantageous for obtaining a generally uniform dispersion of fibers of significantly different diameters.

The preferred article of the invention is a bicomponent mat. The fiber may be prepared in any desired length known in the art. The method of this invention involves making a bicomponent mat of glass fibers and wood pulp comprising the steps of: forming a pulp slurry by mixing wood pulp, water, and a cationic polymer; forming a slurry of glass fibers by mixing together a dispersant, water, glass fiber, and a viscosity modifier; combining and mixing the pulp slurry and the slurry of fibers to form a wet mat; applying a binder to the wet mat; and removing any excess moisture and curing the binder.

The mat generally comprises three components; glass fibers, pulp fibers, and an organic binder. In the finished mat, the glass fibers are present in the range of about 40% to about 90% by weight, preferably, in the range of about 60% to about 75%, and most preferably, in the range of about 70% to about 75%. The pulp fiber is present in the range of about 5% to about 35% by weight, preferably, in the range of about 8% to about 15%, and most preferably, about 10%. The organic binder is present in the range of about 5% to about 30% by weight, preferably in the range of about 15% to about 20%, and most preferably, about 18%. Typically, the mats of the invention will contain small amounts of a dispersant, such as a surfactant. It is preferred that the mat contains less than about 1% by weight of surfactant.

The invention involves the combination of a pulp surface treatment and a compatible dispersion system. The first component of the disclosed method is the treatment of cellulosic fibrous components or pulp fibers. The preferred cellulosic fibrous component is wood pulp, particularly derived from hardwoods. However, either soft wood pulp or hard wood pulp may be used. The soft wood pulp includes evergreens such as spruce, pine, and the like, that have longer fibers than those of hardwoods. The softwoods preferred for use herein are characterized by an average length to thickness (diameter) ratio, determined microscopically, of about 60:1 to 120:1 and preferably about 100:1 respectively. The softwood fibers may vary in length from about 0.05 inch to about 0.2 inch.

Commercially available pulps of this kind will typically contain a small percentage of hardwood, usually in the range of ten to twenty percent, or more. If the necessary external and internal fibrillation can be obtained, such pulps are entirely operable for the purposes of the present invention. The operative softwood pulps include those characterized as mechanical pulp or groundwood and chemical pulp including, sulfite and sulfate, and preferably sulfate kraft, or that derived from the soda process.

Bleached pulps are preferred in instances where a white product is desired. Otherwise, unbleached pulps are suitable for use in the invention. Preferred pulps are those capable of attaining a density and breaking length as a result of internal and external fibrillation necessary to the practice of the invention. The preferred source of pulp fibers is International Paper.

The pulp is initially soaked in water and subsequently agitated by a conventional blender or mixer to form a slurry. The weight percentage of pulp in the water is not particularly limited, so long as the pulp may be dispersed in the water. A cationic polymer is added to treat the pulp slurry. While the preferred cationic polymer is Nalco 7530, which is an acrylamide modified cationic copolymer available from Nalco Chemical Company, Naperville, Ill., the artisan will appreciate that several types of cationic polymers may be used. The weight percentage of cationic polymer added to the pulp slurry may depend on the amount of pulp used, the composition, charge density, and molecular weight of the polymer used, as well as the size and type of container (e.g. stainless steel or plastic) used in the process.

The term "white water" refers to an aqueous solution in which the glass fibers are dispersed and which may contain numerous dispersants, thickeners, softening chemicals, hardening chemicals, or dispersed or emulsified thermoplastic polymers. In the preferred embodiment, the white water is preferably formed while the pulp is being agitated in the pulp slurry.

In forming a generally uniform dispersion of the fibers in a water carrier medium, a system of water, a dispersing agent (dispersant), and a viscosity modifier may be used. A viscosity modifier that increases the viscosity of the water carrier medium will generally be selected and is referred to as a thickener. A dispersant that beneficially aids fiber interaction with the water carrier medium to assist in dispersion of the separate fibers and acts to wet out the surface of the fibers, is typically chosen. Also, pH adjustment of the water carrier medium may be advantageous depending on the types of fibers. In addition, it may be advisable in some cases to use a suitable anti-foaming agent or other processing aids well known to those skilled in the art.

Various ingredients may be used as the viscosity modifier and dispersant, and it is not so important which additives are chosen, but rather that a generally uniform dispersion of fibers in the furnish is produced. Also, the dispersion will advantageously be sufficiently stable that a web laid from the dispersion is generally uniform and free of aggregated or clumped fibers.

According to the invention, a dispersant is added initially to water. The dispersant is a surfactant that helps break bundles and disperse filaments. The surfactant assists in releasing the sizing agent typically present in commercially available glass fiber. Selection will be based upon compatibility with the different fiber components and with other processing aids. The surfactant may be a cationic or amphoteric surfactant. A cationic surfactant may be used, but in a continuous process, an amphoteric surfactant is preferred. The preferred dispersant for the invention is an amphoteric surfactant, for example, Mirataine CBS, a cocamidopropyl hydroxysultaine. The dispersants may be deposited on and coat the fiber surface. This coating action may aid in deterring the formation of clumps, tangles and bundles. This surfactant makes the pulp slurry and the white water compatible with each other.

The concentration of the dispersant in the furnish may be varied within relatively wide limits and may be as low as 50 ppm and up to as high as about 300 ppm. Higher concentrations up to about 500 ppm may be used but may be uneconomical and cause low wet web strength. Thus, it is preferred that the amount of the dispersant ranges from preferably, about 50 ppm up to about 200 ppm.

It is believed that by adding the dispersant to an aqueous medium first allows the fibers to enter a favorable aqueous environment containing the dispersant which is immediately conducive to their maintaining their individuality with respect to each other whereby there is substantially no tendency to flocculate or form clumps, tangles or bundles. By employing the dispersing agents of the invention, the fibers are dispersed to arrive at the conditions of nonflocculation.

After the dispersant is added to the aqueous mixture, non-cellulosic fibrous components or glass fibers are added. The non-cellulosic fibrous component are chosen from the group consisting of glass fibers, rock wool and other suitable mineral fibers. Of these fibers, the preferred material is chopped glass fibers such as fibers commercially available E Fiberglass of Owens-Corning, in Toledo, Ohio. Glass fibers do not absorb any moisture, have high tensile strengths, very high densities and excellent dimensional stability. The glass fibers suitable for use in the invention have average lengths of from about 0.1 inch to 1.5 inch, preferably 0.75 inch to 1.25 inch and have an average diameter in the range of 5 to 30 microns, preferably 10 to 20 microns, and most preferably, 16 microns. These commercially available fibers are characteristically sized which causes the otherwise ionically neutral glass fibers to form and remain in bundles. Sizes such as this are commonly employed by manufacturers of glass fibers and the release of the sizing composition by a cationic antistatic agent eliminates fiber agglomeration and permits a uniform dispersion of the glass fibers upon agitation of the dispersion in the tank. The typical amount of glass fibers for effective dispersion in the glass slurry is within the range of 0.5 percent to about 3.0 percent, and most preferably about 1 percent, by weight of the dispersion. After the dispersion is diluted and prior to forming the mat, the amount of glass fibers is up to about 0.1%, preferably, about 0.02 to about 0.06%, and most preferably, about 0.03 to about 0.05% by weight.

After the fibers have been added and mixed, a viscosity modifier is added to the aqueous solution. The viscosity modifier acts to increase the viscosity of the water carrier medium and also acts as a lubricant for the fibers. Through these actions, the viscosity modifier acts to combat flocculation of the fibers. The concentration of the viscosity modifier in the furnish may likewise be varied within relatively wide limits. Concentrations may be from about 50 ppm to about 1,000 ppm, or in some cases as much as about 1%.

Any viscosity modifier that achieves a viscosity in the range of 1.5 to 6.0 centipoise in the furnish may be used. Preferably, the viscosity modifier may achieve a viscosity in the range of 2.0 to 4.0 centipoise, and most preferably, in the range of 3.0 to 3.5. Useful viscosity modifiers also include synthetic, long chain, linear molecules having an extremely high molecular weight, on the order of at least about 1 million and up to about 15 million, or 20 million, or even higher. Preferably, molecules with a molecular weight of 16 million is used. Examples of such viscosity modifiers are polyethylene oxide which is a long chain, nonionic homopolymer and has an average molecular weight of from about 1 to 7 million or higher; polyacrylamide which is a long, straight chain, nonionic or slightly anionic homopolymer and has an average molecular weight of from about 1 million up to about 15 million or higher; acrylamide-acrylic acid copolymers which are long, straight chain, anionic polyelectrolytes in neutral and alkaline solutions, but nonionic under acid conditions, and possess an average molecular weight in the range of about 2 to 3 million, or higher; and polyamines which are long, straight chain, cationic polyelectrolytes and have a high molecular weight of from about 1 to 5 million or higher. The preferred viscosity modifiers include modified polyacrylamides available from Nalco Chemical Company, such as Nalco 2824.

Other useful viscosity modifiers include nonionic associative thickeners, for example, relatively low (10,000–200,000) molecular weight, ethylene oxide-based, urethane block copolymers. These associative viscosity modifiers are particularly effective when the fiber furnish contains 10% or more staple length hydrophobic fibers. Commercial formulations of these copolymers are sold by Rohm and Haas, Philadelphia, Pa., under the trade names ACRYSOL RM-825 and ACRYSOL RHEOLOGY MODIFIER QR-708, QR-735, and QR-1001 which comprise urethane block copolymers in carrier fluids. ACRYSOL RM-825 is 25% solids grade of polymer in a mixture of 25% butyl carbitol (a diethylene glycol monobutylether) and 75% water. ACRYSOL RHEOLOGY MODIFIER QR-708, a 35% solids grade in a mixture of 60% propylene glycol and 40% water can also be used. Similar copolymers in this class, including those marketed by Union Carbide Corporation, Danbury, Conn. under the trade names SCT-200 and SCT-275 and by Hi-Tek Polymers under the trade name SCN 11909 are useful in the process of this invention.

Another class of associative suitable viscosity modifiers, preferred for making up fiber furnishes containing predominantly cellulose fibers, e.g. rayon fibers or a blend of wood fibers and synthetic cellulosic fibers such as rayon, comprises the modified nonionic cellulose ethers of the type disclosed in U.S. Pat. No. 4,228,277 incorporated herein by reference in its entirety. Such cellulosic ethers are sold under the trade name AQUALON by Hercules Inc., Wilmington, Del. AQUALON WSP M-1017, and include a hydroxy ethyl cellulose modified with a C-10 to C-24 side chain alkyl group and having a molecular weight in the range of 50,000 to 400,000 that may be used in the whitewater system.

Other viscosity modifiers suitable for use in the invention are available under the trade designations Hyperfloc CP 905 L, Hyperflock CE 193, Hyperfloc AE 847, and Hyperflock AF 307, all commercially available from Hychem, Inc., Tampa, Fla.; Superfloc MX 60, Magrifloc 1885 A, Superflock A 1885 and Cytec AF124, commercially available from Cytec Industries, West Paterson, N.J., and Jayflock 3455 L, commercially available from Callaway Chemical Company, Columbus, Ga.

A conventional defoamer may be used in the white water to prevent the buildup of foam during the forming process.

The wet-laid process involves forming an aqueous dispersion of discontinuous fibers such as chopped fibers or chopped strands with the above ingredients. The pulp slurry and the glass fiber slurry are combined. The bicomponent fiber slurry may then be diluted with water to form a thin stock or furnish. The slurry is then placed on the screen or cylinder in a known manner and precipitated into the nonwoven, sheet-like mat by the removal of water, usually by a suction and/or vacuum device to form a wet mat. In the wet mat, the pulp is present in an amount of about 5 to about 35 weight % of total solids, the glass fibers are present in an amount of about 40 to about 90 weight % of total solids, and the dispersant is present in the wet mat in an amount of about 1 weight % or less of total solids. The mat is dried at a temperature below the bonding temperature to remove the moisture.

A mat binder may be applied to the wet mat. Suitable mat binders for application to the-web include any material that will affect a bond at a lower temperature than that which would result in consolidation of the plastics material within the structure. Suitable binders include poly(vinyl alcohol), poly(vinyl acetate), carboxymethyl cellulose and starch, and SBR modified urea formaldehyde (UF) resin. The binder is present in the wet mat in an amount of about 5 to about 30 weight percent of total solids.

Having applied a binder to the mat, the drying and curing of the mat may be done by any well known means of drying water in the mat and heating it. For example, the mat may be heat cured. One known drying machine is a Honeycomb System Through-Air Dryer. The heating temperature may be from 246° C. to 260° C. It is to be appreciated that too high a temperature will damage the bicomponent mat and too low a temperature will not achieve the desired bonding.

An example of a suitable heating process includes passing the mat through a drying machine in which the mat is dried and the resin is cured, e.g. thermoset or chemically bonded. Generally the resin may be a modified UF resin with SBR.

When drying and curing the mat by heating, the melting temperature may vary, with an appropriate elevated temperature depending upon the respective melting points of the bicomponent fiber components. Selection of a relatively higher temperature generally requires a relatively shorter exposure time, whereas selection of a relatively lower temperature usually requires a relatively longer exposure time. The mat is thereafter cooled to below the resolidification temperature of the heat-bondable component to form bonds between the fibers.

An optional size, preferably of a hard acrylic resin, may be deposited on one or both sides of the resulting sheet in a manner well known in the art following the evaporative drying step. In the preferred embodiment of the invention, such a sizing is employed to assure a smooth uninterrupted surface free from errant fibers, or the like. This size serves as well to assure adherence of any minor residues of impurities, filler or fibers that may remain loose or above the surface of the formed sheet.

The bicomponent mats of the invention may be made using conventional equipment in a batch, semi-batch, or a continuous process. For example, in a small batch process, the bicomponent mat may be formed by draining off water from the furnish by use of a deckle box, and the bicomponent fibers may be caught on the top of the screen of the deckle box. The wet bicomponent fiber mat may be dried and cured with a suitable binder to form a hand sheet.

For a commercial scale process, the bicomponent mats of the invention are generally processed through the use of papermaking-type machines such as commercially available Fourdrinier, wire cylinder, Stevens Former, Roto Former, Inver Former, Venti Former, and inclined Delta Former machines. Preferably, an inclined Delta Former machine is utilized. A bicomponent mat of the invention can be prepared by forming pulp and glass fiber slurries and combining the slurries in mixing tanks, for example. The amount of water used in the process may vary depending upon the size of the equipment used. Typical volumes of water range from about 300,000 liters to about 1,850,000 liters. The thick stock may be delivered into a silo where the thick stock is diluted to form a thin stock or furnish. The furnish may be passed into a conventional head box where it is dewatered and deposited onto a moving wire screen where it is dewatered by suction or vacuum to form a non-woven bicomponent web. The web can then be coated with a binder by conventional means, e.g., by a flood and extract method and passed through a drying oven which dries the mat and cures the binder. The resulting mat may be collected in a large roll.

The foregoing detailed description has been given for clearness of understanding only and no unnecessary limitations should be understood therefrom as modifications will be obvious to those skilled in the art.

While the invention has been described in connection with specific embodiments thereof, it will be understood that it is capable of further modifications and this application is intended to cover any variations, uses, or adaptations of the invention following, in general, the principles of the invention and including such departures from the present disclosure as come with known or customary practice within the art to which the invention pertains and as may be applied to the essential features hereinbefore set forth and as follows in scope of the appended claims.

The invention will be described in greater detail in the following examples wherein there are disclosed various embodiments of the present invention for purposes of illustration, but not for purposes of limitation of the broader aspects of the present inventive concept.

EXAMPLES

In the following examples it is noted that Examples 1–4 and 6 were performed with a handsheet process. Furthermore, Examples 5, 7, and 8 used a pilot scale wet process line as a continuous process to make a continuous mat.

Example 1

A bicomponent mat of glass fibers and pulp fibers was prepared. The pulp fibers were initially prepared from hardwood pulp obtained from the Elk Corporation located in Dallas, Tex., which purchased the pulp from International Paper. This Example explores glass fiber dispersion and the compatibility between glass fibers and wood pulp.

A gram of pulp at approximately 95% was soaked in approximately 150 ml of water. The pulp and water mixture was agitated or pulped in a food processor (blender) for 2 minutes with high agitation.

During the preparation of the pulp, a thick stock mixture slurry was prepared. Initially, a dispersant was added dropwise via a pipette to 5 liters of water and agitation began with a timer started. The dispersant used was Rhodameen VP-532/SPB, which is commercially available from Rhone-Poulenc. After 10 seconds, glass fibers were added to the mixture to form a thick stock. The glass fibers used have a length of 1 inch and diameter of 16 microns and are available as wet-use chopped strands 9501, 9502, 685, and 786 from Owens Coming. A viscosity modifier was added one minute after agitation began. The viscosity modifier was Nalco 2824 (Anionic Polyacrylamide) and it was diluted to 0.5% solids.

At two minutes, the prepared pulp was added to the thick stock mixture. Finally, at the 13 minute point, mixing is complete and the slurry is ready to be formed into a handsheet.

A deckle box was filled with 35 liters of water. During the thick stock preparation, 40 mL of viscosity modifier at 0.5 wt % solids was added into the deckle box at the twelve minute mark and it was mixed with about 4 strokes. The viscosity modifier was a mixture of 115 g of Nalco 2824, an anionic polyacrimide, and 7885 g of water that were mixed for 30 minutes. A minute after the viscosity modifier was added, the thick stock was poured into the deckle box. The mixture was stroked 4 times to mix it and water was then drained from the mixture.

In this example, no binder was used on the resulting handsheet. Instead, the hand sheet was sprayed with a fast drying solution, such as "Rust Master™ Enamel" made by Glidden, which held fibers together very well.

For Runs 1–12, the pH of the thick stock mixture was about 7. For Runs 13–15, the pH of the thick stock mixture was adjusted to 8.5 with sulfuric acid.

| Run # | Dispersant (Drops) | Fiberglass (grams) | Viscosity Modifier @ 0.5% (mL) | Pulp (grams) | Viscosity Modifier added into Deckle box @ 0.5% (mL) |
|---|---|---|---|---|---|
| 1 | VP532 (7) | 9502 fiber (6) | 40 | 1 | 40 |
| 2 | VP532 (7) | 9502 fiber (6) | 80 | 1 | 40 |
| 3 | VP532 (7) | 9502 fiber (6) | 80 | 1 | 80 |
| 4 | VP532 (7) | 9501 fiber (6) | 40 | 1 | 40 |
| 5 | VP532 (7) | 9501 fiber (6) | 80 | 1 | 40 |
| 6 | VP532 (7) | 9501 fiber (6) | 80 | 1 | 80 |
| 7 | VP532 (7) | 685 fiber (6) | 40 | 1 | 40 |
| 8 | VP532 (7) | 685 fiber (6) | 80 | 1 | 40 |
| 9 | VP532 (7) | 685 fiber (6) | 80 | 1 | 80 |
| 10 | VP532 (7) | 786 fiber (6) | 40 | 1 | 40 |
| 11 | VP532 (7) | 786 fiber (6) | 80 | 1 | 40 |
| 12 | VP532 (7) | 786 fiber (6) | 80 | 1 | 80 |
| 13 | VP532 (7) | 9502 fiber (6) | 80 | 1 | *40 PH = 8.5 |
| 14 | VP532 (7) | 685 fiber (6) | 80 | 1 | *40 PH = 8.5 |
| 15 | VP532 (7) | 786 fiber (6) | 80 | 1 | *40 PH = 8.5 |

It was observed that the more viscosity modifier used, the better fiber dispersion and web formation. Also, adjustment of pH also proved helpful.

Example 2

Another bicomponent mat was prepared. The procedure used was the same as described in Example 1 with the exception of a different dispersant. In this example, dispersant was Mirataine CBS, a hydroxysultaine which is commercially available Rhone-Poulenc. The length of the glass fibers used was 1".

| Run # | Dispersant (Drops) | Fiberglass (grams) | VM @ 0.5% (mL) | Pulp (g) | Deckle Box VM @ 0.5% (ml) |
|---|---|---|---|---|---|
| 16 | CBS (7) | 786 (7) | 40 | 1 | 40 |
| 17 | CBS (7) | 9501 (6) | 40 | 1 | 40 |
| 18 | CBS (7) | 9502 (6) | 40 | 1 | 40 |
| 19 | CBS (7) | 685 (6) | 40 | 1 | 40 |
| 20 | CBS (7) | 786 (6) | 80 | 1 | 40 |
| 21 | CBS (7) | 9501 (6) | 80 | 1 | 40 |
| 22 | CBS (7) | 9502 (6) | 80 | 1 | 40 |
| 23 | CBS (7) | 685 (6) | 80 | 1 | 40 |

Example 3

Another bicomponent mat was prepared in this example. The procedure used is basically the same as described in Example 2. The difference is that the wood pulp was treated before being combined with the fiberglass slurry.

The wood pulp was prepared with a cationic polymer, specifically, Nalco 7530. While preparing the thick stock, a specified amount of Nalco 7530 is added to the beaker, which contains about 150 ml of pulp slurry, and is then mixed. Nalco 7530 was added to the pulp slurry one minute after starting the timer and the treated pulp slurry was added to the glass slurry one minute later.

In the following table, the number in the <> in the Pulp column is the number of drops of Nalco 7530 that are added to the pulp slurry to treat its surface (i.e., 7 drops of Nalco 7530 were used to treat 1 gram of pulp in 150 ml water).

| Run # | Dispersant (Drops) | Glass Fiber (grams) | VM @ 0.5% (mL) | Pulp (grams) | Deckle Box VM @ 0.5% (ml) |
|---|---|---|---|---|---|
| 24 | CBS (7) | 9502 (6) | 40 | 1 <7> | 40 |
| 25 | CBS (7) | 9501 (6) | 80 | 1 <7> | 40 |
| 26 | CBS (7) | 786 (6) | 80 | 1 <7> | 40 |
| 27 | CBS (7) | 9502 (6) | 80 | 1 <7> | 40 |
| 28 | CBS (7) | 9502 (6) | 80 | 1 <7> | 40 |
| 29 | CBS (7) | 9502 (6) | 80 | 1 <7> | 40 |
| 30 | CBS (7) | 9501 (6) | 80 | 1 <7> | 40 |

Figure 2:
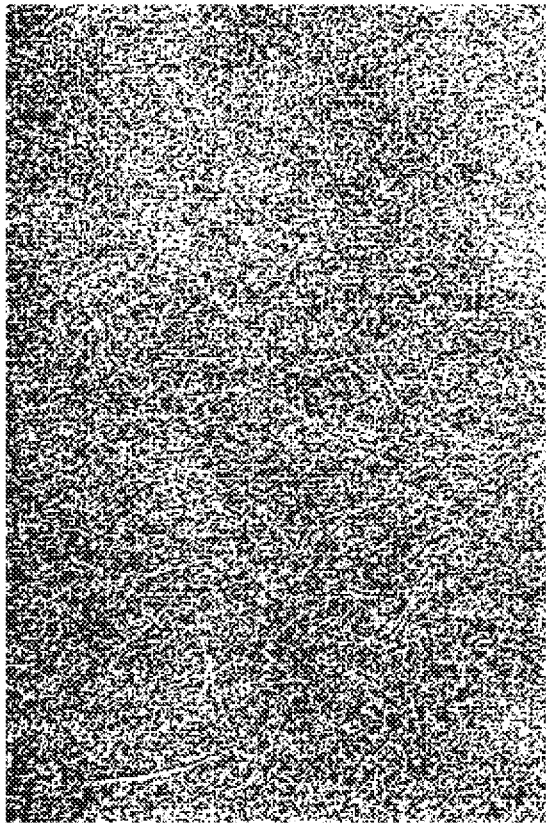
FIG. 2 is a photograph of a mat produced in Example 3.

As shown in FIGS. 1 and 2, it is the combination of pulp surface treatment with Nalco 7530 and (2) the dispersant of CBS that makes the pulp and fiber glass compatible. FIG. 1 is from Run #22 in Example 2 (i.e. CBS dispersant only) and FIG. 2 is from Run #27 in Example 3, the combination.

In conclusion, by treating the pulp surface with Nalco 7530, the three glass fibers used are compatible with the treated pulp and can be formed into good handsheets.

Example 4

Another bicomponent mat was prepared. The same procedure used in Example 3 was repeated with the exception of VP532 as the dispersant.

| Run # | Dispersant (Drops) | Glass (grams) | VM @ 0.5% (mL) | Pulp (grams) | Deckle Box VM @ 0.5% (ml) |
|---|---|---|---|---|---|
| 31 | VP532 (7) | 9502 (6) | 80 | 1 <7> | 40 |
| 32 | VP532 (7) | 9501 (6) | 80 | 1 <7> | 40 |
| 33 | VP532 (7) | 685 (6) | 80 | 1 <7> | 40 |
| 34 | VP532 (7) | 786 (6) | 80 | 1 <7> | 40 |

Example 5

Another bicomponent mat of pulp and glass fibers was prepared. The conditions are shown in the following table.

The specified amount of pulp was soaked, and then dispensed in water. The pulp was hardwood pulp provided by the Elk Corporation.

The pulp was prepared in advance with one hour agitation. If treatment of the pulp is needed, Ammonium, or Nalco 7530, or a PAM viscosity modifier, the treatment is done about 5–20 minutes before each run. The additives were added into the pulp slurry, and mixed for 5 minutes.

In the first procedure for this Example (Procedure I), initially, a dispersant, a defoamer, (Foam Master® from Henkel Corporation), and glass fibers were added to water. The glass fibers used were Owens Coming 1" 786 fibers and 1.25" 9502 fibers. After three minutes, a diluted viscosity modifier, specifically Nalco 2824 or Cytec AF 124, was added to the mixture. The previously treated pulp was added between the eight and eight and a half minute mark. At ten minutes, the slurry is ready. The binder used was a UF/SBR binder. The drying temperature was 475° F.

In a second procedure for this Example, the steps were the same as the first procedure with the exception that the viscosity modifier was added at the five minute mark. The first and second procedures are designated as I and II, respectively, in the "Procedure" column on the following chart. In the table, # denotes "pounds," and "A" denotes an ammonium solution of about 23%.

Figure 3:
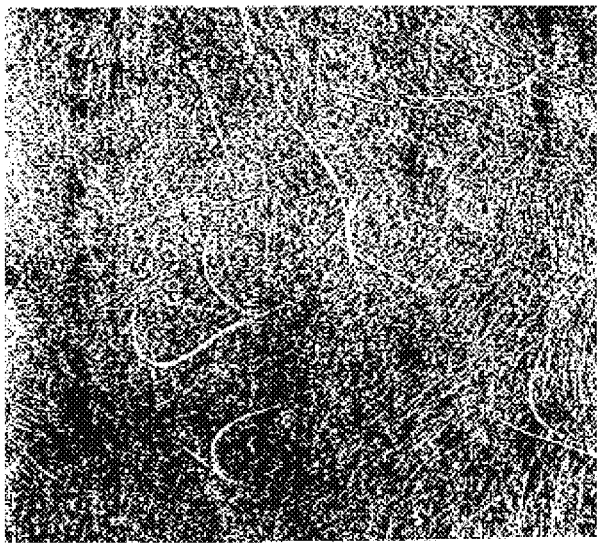
FIG. 3 is a photograph of a mat produced in Example 5.
Figure 4:
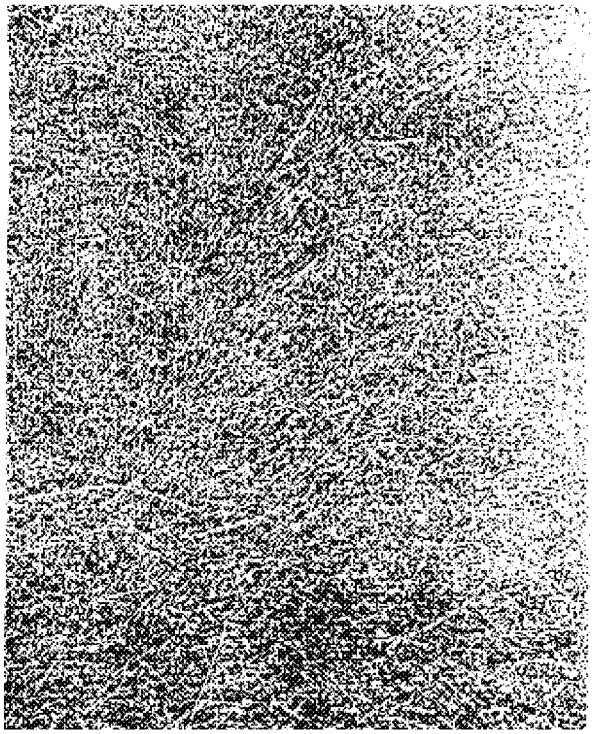
FIG. 4 is a photograph of a mat produced in Example 6.
Figure 5:
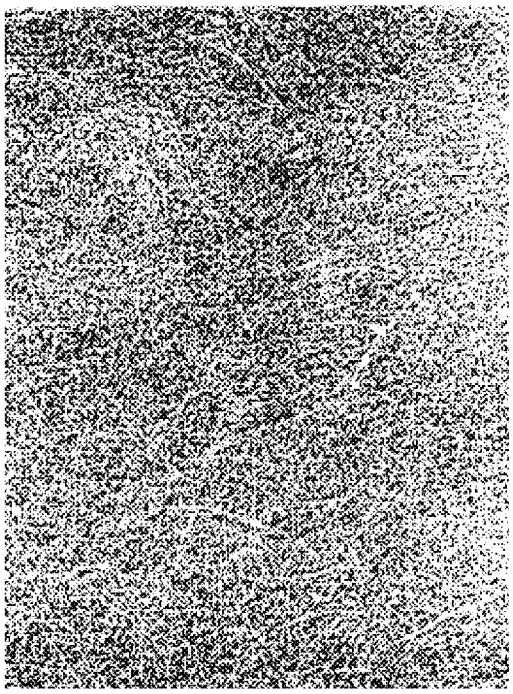
FIG. 5 is a photograph of a mat produced in Example 6.
Figure 6:
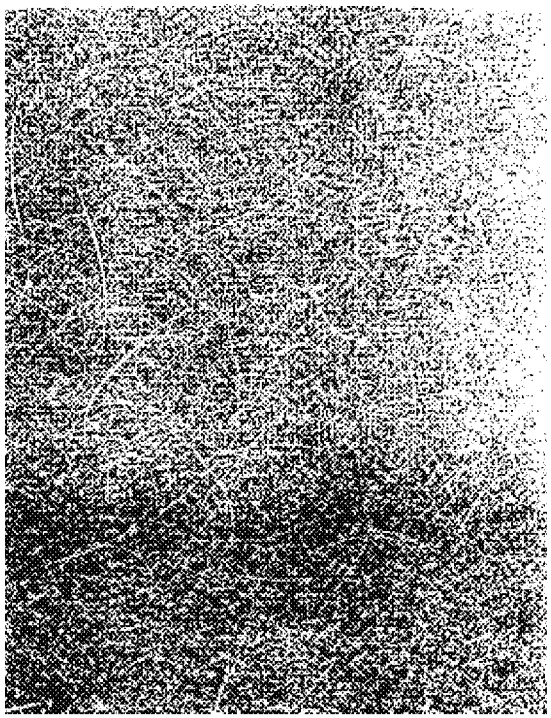
FIG. 6 is a photograph of a mat produced in Example 6.
Figure 7:
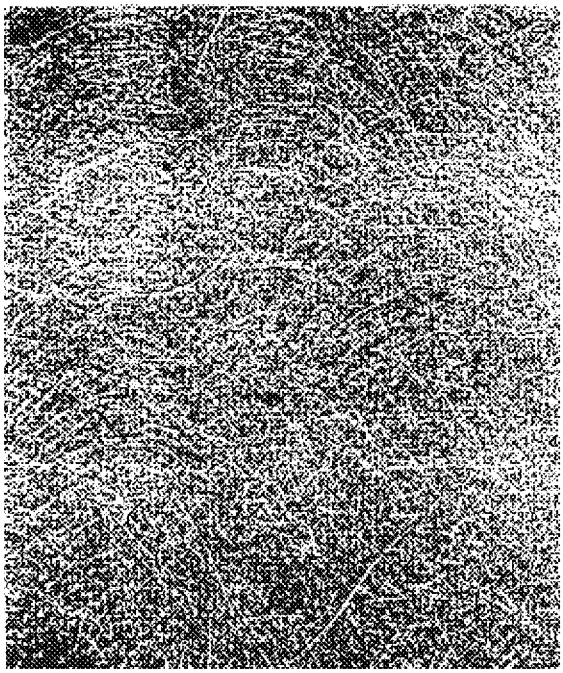
FIG. 7 is a photograph of a mat produced in Example 6.
Figure 8:
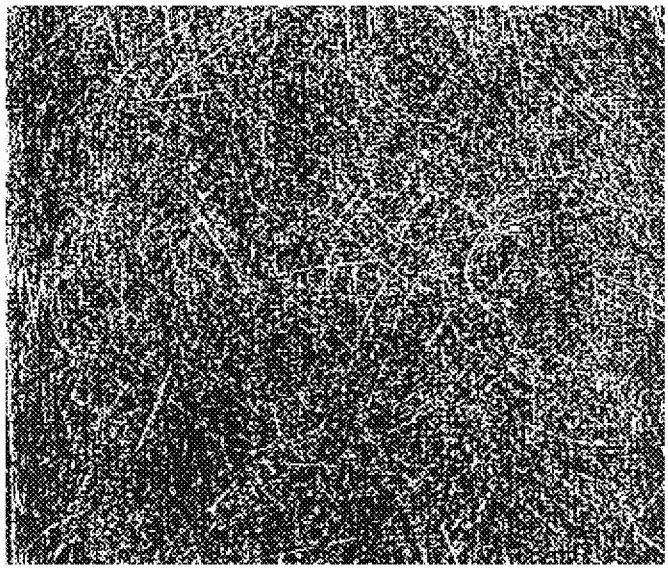
FIG. 8 is a photograph of a mat produced in Example 6.
Figure 9:
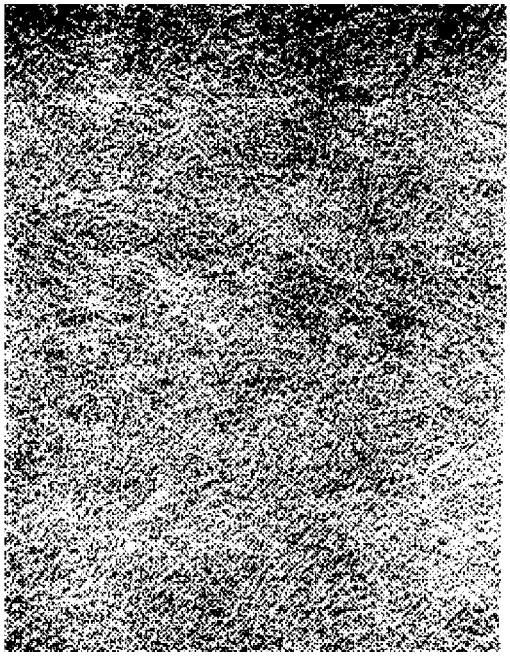
FIG. 9 is a photograph of a mat produced in Example 8.
Figure 10:
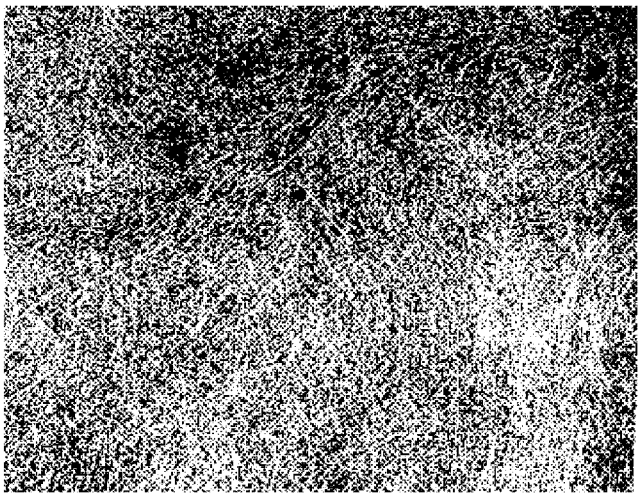
FIG. 10 is a photograph of a mat produced in Example 8.
Figure 11:
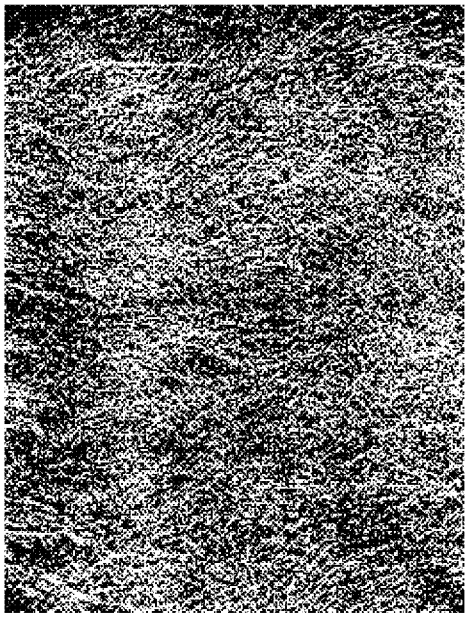
FIG. 11 is a photograph of a mat produced in Example 8.
Figure 12:
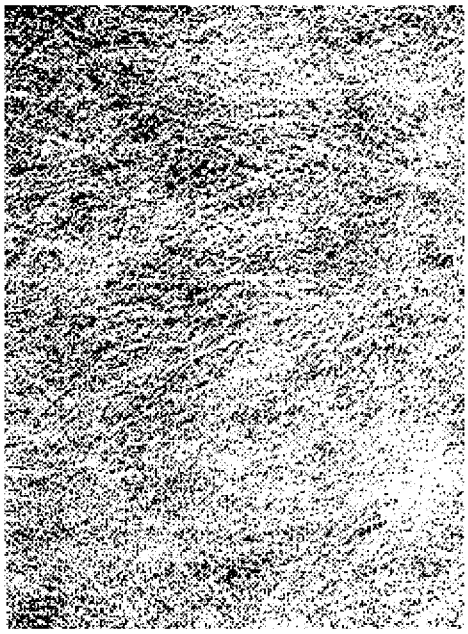
FIG. 12 is a photograph of a mat produced in Example 8.
Figure 13:
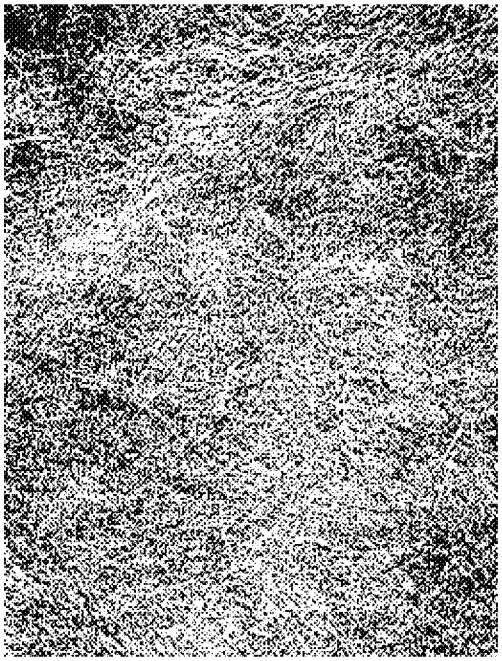
FIG. 13 is a photograph of a mat produced in Example 8.
Figure 14:
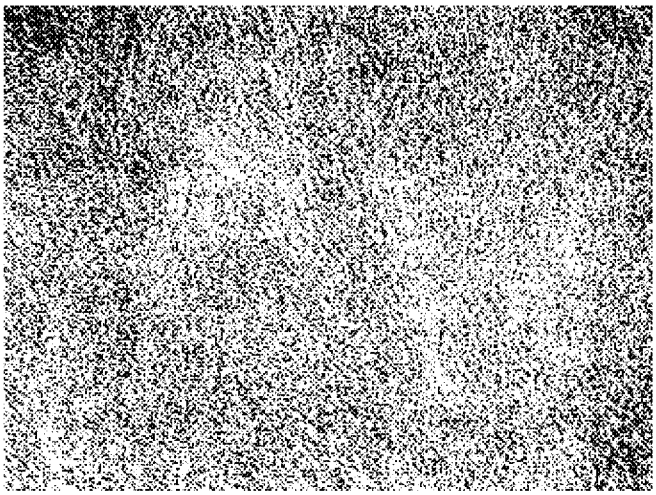
FIG. 14 is a photograph of a mat produced in Example 8.

The resulting product for Run #32 is shown in FIG. 3.

fiberglass was added at t=10 seconds. The specified viscosity modifier was added at t=1 minute. The pretreated pulp was added at t=2 minutes. Agitation was stopped at t=13 minutes.

For the deckle box, 60 mL of viscosity modifier was added at t=12 minutes. At t=13 minutes, the thick stock was added. The mixture was stroked 4 times, and the water was drained.

| | White water | Fiber | Pulp | Dispersant | Defoamer | Procedure |
|---|---|---|---|---|---|---|
| | viscosity = 1.68; pH = 7.0 | | | | | |
| 1 | 40 mL | 786, 15# | no | 60 mL | double | I |
| 2 | 40 mL | 6502, 15# | No | 60 mL | double | |
| | Addition of 300 AF 124 vm into the system and mixed well; viscosity = 1.80 and pH = 7 | | | | | |
| 3 | 40 mL + 40 mL A | 786, 14# | 2# pulp | 60 mL | double | I |
| 4 | 40 mL + 40 mL A | 9502, 14# | 2# pulp | 60 mL | double | I |
| 5 | 60 mL + 200 mL A | 786 | 0.8# + 100 mL A | 60 mL | double | I |
| 6 | 60 mL + 200 mL A | 9502 | 0.8# + 100 mL A | 60 mL | double | I |
| | Viscosity = 1.8, pH - 7.5, the white water is normal | | | | | |
| 7 | 40 mL | 786 | no pulp | 60 mL | double | I |
| 8 | No VM + 100 mL A | 786 | 1.5# pulp + 100 mL A + 40 MI VM | | double | I |
| 9 | 40 mL | 786 | no pulp | 60 mL | double | I |
| | Check pH = 8.5 and viscosity = 1.70 | | | | | |
| 10 | 160 mL | 786 | 1.5# pulp + 200 mL A | 60 mL | double | II |
| 11 | 160 mL | 786 | 1.5# pulp + 500 mL A | 60 mL | double | II |
| | pH = 8.5 viscosity = 1.90 | | | | | |
| 12 | 40 Ml | 786 | no pulp | 60 mL | double | I |
| 13 | 40 mL | 786 | no pulp | 60 mL | double | I |
| 14 | 40 mL | 786 | no pulp | 60 mL | double | I |
| | viscosity = 1.90, pH = 8.5 | | | | | |
| 15 | 200 mL + 100 mL A | 786 | 1.5# pulp + 300 mL A | 60 mL | double | I |
| 16 | 200 mL + no. A | 786 | 1.5# pulp + 100 mL A | 60 mL | double | I |
| 17 | 200 mL + 100 mL A | 786 | 1.5# pulp + 100 mL A | 60 mL | double | I |
| 18 | 200 mL + 100 mL A | 786 | 1.5# pulp + 100 mL A | 60 mL | double | I |
| 19 | 40 mL | 786 | no pulp | 60 mL | double | I |
| | pH = 8.5 viscosity = 2.15 | | | | | |
| 20 | 200 mL + 100 mL A | 786 | 1.5# pulp + 200 mL A | 90 mL | double | I |
| 21 | 200 mL + no. A | 786 | 1.5# pulp + 70 mL A + 30 mL AF124 | 90 mL | double | I |
| | viscosity = 2.25 pH = 8.5 | | | | | |
| 22 | 40 mL | 786 | no pulp | 60 mL | double | I |
| 23 | 200 mL + 100 mL A | 786 | 1.5# pulp + 100 mL A | 90 mL | double | I |
| 24 | 100 mL + 100 mL A | 786 | 1.5# pulp + 70 mL A + 30 mL AF124 | 90 mL | double | I |
| 25 | 100 mL + 100 mL A | 786 | 1.5# pulp + 70 mL A + 40 g NaHC03 | 90 mL | double | I |
| 26 | 100 mL + 100 mL A | 786 | 1.5# pulp + 70 mL A + 35 mL N7530 | 90 mL | double | I |
| 27 | 300 mL + 100 mL A | 786 | 1.5# pulp + 100 mL | 90 mL | double | I |
| | pH = 8.5 viscosity + 2.05; got rid of part of ww | | | | | |
| 28 | | 786 | no pulp | 60 mL | double | I |
| 29 | 200 mL + 100 mL A | 786 | 1.5# pulp + 100 mL A + N7530 | 90 mL | double | I |
| 30 | 200 mL + 100 mL A | 786 | 1.5# pulp + 70 mL A + 50 mL N7530 | 90 mL | double | I |
| 31 | 200 mL + 100 mL A | 786 | 1.5# pulp + 70 mL A + 50 mL N7530 | 90 mL | double | I |
| 32 | 200 mL + 100 mL A | 786 | 1.5# pulp + 70 mL A + 50 mL N7530 | 90 mL | double | I |
| 33 | 200 mL + 100 mL A | 786 | 1.5# pulp + 70 mL A + 50 mL N7530 | 90 mL | double | I |

Example 6

Another bicomponent mat of pulp and glass fibers was prepared. Conditions similar to those described for Example 1 above were repeated. The pulp is hardwood pulp. Preweighed pulp was prepared in a blender with about 150 mL of water for 2 minutes. The blended pulp was treated with a specified amount of cationic polyacrylamide before use.

The thick stock was prepared by the following procedure: Agitation pressure was set at about 17 psi. specified amount of dispersant was added at t=0. The specified amount of This time a UF binder of 95% UF Resin and 5% carboxylic SBR latex was used. The prepared handsheet was dried and cured in a conventional oven for 15 minutes @ 175° C.

The variables in this Example are the cationic polymer, which was Nalco 7530, the viscosity modifier which was Nalco 2824, the dispersant which was Mirataine CBS. These three variables are shown on the following tables as x, y, and z, respectively, and are varied as shown in columns x, y, and z in the tables. In the tables x1, x2, and x3 denotes 4, 9, and 14 drops respectively of Nalco 7530; y1, y2, and y3 denotes 50, 100, and 150 ml, respectively, of Nalco 2824; and z1, z2, and z3 denotes 3, 7, and 11 drops, respectively of Mirataine CBS. For the chemical addition, 5 drops of Nalco 7530 equals approximately 100 mg, 1 drop equals 20 mg; and 5 drops of Mirataine CBS equals about 100 mg, 1 drop equals 20 mg.

Handsheets prepared in runs # 17, 28, 47, 69, and 77 of Example 6 are shown in FIGS. 4, 5, 6, 7, and 8, respectively.

In the following tables, dispersion (G) are the scores for glass fiber dispersion, with "1" being the worst and "9" being the best.

Dispersion (C) are the scores for wood pulp dispersion, with 1 being the lowest and 3 the best.

Runs #1–30, 31–60, and 61–90 are identical except that different glass fibers are used. For runs 1–30, glass fibers with 9502 sizing was used; for 31–60, with 9501 sizing; and for runs 61–90, with 786 sizing, all available from Owens Coming.

| | | | | Nalco 7530 | VM D | | Dispersion (G) | | | | Dispersion (C) | | | |
|---|---|---|---|---|---|---|---|---|---|---|---|---|---|---|
| Run | x | y | z | Drop | mL | drop | A | D | R | Avg. | A | D | R | Avg. |
| | | | Run #1–30: 9502M 1" fiber, 6.0 g fixed (87%), 1.0 g pulp fixed (91%) basis wt. = 1.67#/csf, pulp content = 15% | | | | | | | | | | | |
| 1 | x1 | y1 | z1 | 4 | 50 | 3 | 2 | 2 | 2 | 2 | 3 | 3 | 3 | 3 |
| 2 | x1 | y1 | z2 | 4 | 50 | 7 | 2 | 2 | 2 | 2 | 3 | 3 | 3 | 3 |
| 3 | x1 | y1 | z3 | 4 | 50 | 11 | 2 | 2 | 2 | 2 | 3 | 3 | 3 | 3 |
| 4 | x1 | y2 | z1 | 4 | 100 | 3 | 3 | 5 | 3 | 3 | 3 | 2.5 | 3 | 2.83 |
| 5 | x1 | y2 | z2 | 4 | 100 | 7 | 4 | 5 | 5 | 4.67 | 3 | 2.5 | 3 | 2.83 |
| 6 | x1 | y2 | z3 | 4 | 100 | 11 | 6 | 5 | 5 | 5.33 | 3 | 2.5 | 3 | 2.83 |
| 7 | x1 | y3 | z1 | 4 | 150 | 3 | 5 | 5 | 4 | 4.67 | 3 | 2 | 3 | 2.67 |
| 8 | x1 | y3 | z2 | 4 | 150 | 7 | 6 | 5 | 6 | 5.67 | 3 | 2 | 3 | 2.67 |
| 9 | x1 | y3 | z3 | 4 | 150 | 11 | 7 | 6 | 7 | 6.67 | 3 | 2 | 3 | 2.67 |
| 10 | x2 | y1 | z1 | 9 | 50 | 3 | 2 | 2 | 2 | 2 | 3 | 3 | 3 | 3 |
| 11 | x2 | y1 | z2 | 9 | 50 | 7 | 2 | 3 | 2 | 2.33 | 3 | 3 | 3 | 3 |
| 12 | x2 | y1 | z3 | 9 | 50 | 11 | 2 | 3 | 2 | 2.33 | 3 | 3 | 3 | 3 |
| 13 | x2 | y2 | z1 | 9 | 100 | 3 | 5 | 4 | 4 | 4.33 | 3 | 2 | 3 | 2.67 |
| 14 | x2 | y2 | z2 | 9 | 100 | 7 | 5 | 4 | 4 | 4.33 | 3 | 2 | 3 | 2.67 |
| 15 | x2 | y2 | z3 | 9 | 100 | 11 | 6 | 5 | 6 | 5.67 | 2 | 2.5 | 2 | 2.17 |
| 16 | x2 | y3 | z1 | 9 | 150 | 3 | 5 | 5 | 4 | 4.67 | 3 | 2 | 3 | 2.67 |
| 17 | x2 | y3 | z2 | 9 | 150 | 7 | 8 | 9 | 8 | 8.33 | 2 | 2 | 2 | 2 |
| 18 | x2 | y3 | z3 | 14 | 150 | 11 | 8 | 8.5 | 8 | 8.17 | 2 | 1.5 | 2 | 1.83 |
| 19 | x3 | y1 | z1 | 14 | 150 | 3 | 2 | 2.5 | 2 | 2.17 | 3 | 3 | 3 | 3 |
| 20 | x3 | y1 | z2 | 14 | 50 | 7 | 2 | 2.5 | 2 | 2.17 | 3 | 3 | 3 | 3 |
| 21 | x3 | y2 | z3 | 14 | 50 | 11 | 2 | 2.5 | 2 | 2.17 | 3 | 3 | 3 | 3 |
| 22 | x3 | y2 | z1 | 14 | 100 | 3 | 4 | 3 | 3 | 3.33 | 3 | 2 | 3 | 2.67 |
| 23 | x3 | y2 | z2 | 14 | 100 | 7 | 5 | 4 | 3 | 4 | 3 | 2 | 3 | 2.67 |
| 24 | x3 | y3 | z3 | 14 | 100 | 11 | 7 | 7 | 6 | 6.67 | 1 | 1 | 1 | 1 |
| 25 | x3 | y3 | z1 | 14 | 150 | 3 | 6 | 6 | 5 | 5.67 | 3 | 2 | 3 | 2.67 |
| 26 | x3 | y3 | z2 | 14 | 150 | 7 | 7 | 7 | 7 | 7 | 2 | 1.5 | 1 | 1.5 |
| 27 | x3 | y3 | z3 | 14 | 150 | 11 | 7 | 7.5 | 8 | 7.5 | 1 | 1 | 1 | 1 |
| 28 | | #17 | | 9 | 150 | 7 t = 1 + 1 + 5 = 7 | | | | | | | | |
| 29 | | #17 | | 9 | 150 | 7 t = 1 + 1 + 18 = 20 | | | | | | | | |
| 30 | | #17 | | 9 | 150 | 7 t = 1 + 1 + 28 = 30 | | | | | | | | |
| | | | Run #31–60: 9501M 1" fiber, 6.0 g fixed (87%), 1.0 g pulp fixed (91%) basis wt. = 1.67#/csf, pulp content = 15% | | | | | | | | | | | |
| 31 | x1 | y1 | z1 | 4 | 50 | 3 | 2 | 1 | 2 | 1.67 | 3 | 3 | 3 | 3 |
| 32 | x1 | y1 | z2 | 4 | 50 | 7 | 2 | 1 | 2 | 1.67 | 3 | 3 | 3 | 3 |
| 33 | x1 | y1 | z3 | 4 | 50 | 11 | 2 | 2 | 2 | 2 | 3 | 3 | 3 | 3 |
| 34 | x1 | y2 | z1 | 4 | 100 | 3 | 2 | 2.5 | 2 | 2.17 | 3 | 3 | 3 | 3 |
| 35 | x1 | y2 | z2 | 4 | 100 | 7 | 2 | 2.5 | 2 | 2.17 | 3 | 3 | 3 | 3 |
| 36 | x1 | y2 | z3 | 4 | 100 | 11 | 2 | 2.5 | 2 | 2.17 | 3 | 2 | 3 | 2.67 |
| 37 | x1 | y3 | z1 | 4 | 150 | 3 | 4 | 5.5 | 5 | 4.83 | 3 | 2 | 3 | 2.67 |
| 38 | x1 | y3 | z2 | 4 | 150 | 7 | 6 | 5.5 | 6 | 5.83 | 3 | 2.5 | 3 | 2.83 |
| 39 | x1 | y3 | z3 | 4 | 150 | 11 | 7 | 6 | 6 | 6.33 | 3 | 2 | 3 | 2.67 |
| 40 | x2 | y1 | z1 | 9 | 50 | 3 | 2 | 2 | 2 | 2 | 3 | 3 | 3 | 3 |
| 41 | x2 | y1 | z2 | 9 | 50 | 7 | 2 | 2 | 2 | 2 | 3 | 3 | 2 | 2.67 |
| 42 | x2 | y1 | z3 | 9 | 50 | 11 | 2 | 2 | 2 | 2 | 3 | 3 | 3 | 3 |
| 43 | x2 | y2 | z1 | 9 | 100 | 3 | 3 | 2 | 2 | 2.67 | 3 | 2 | 3 | 2.67 |
| 44 | x2 | y2 | z2 | 9 | 100 | 7 | 4 | 3 | 3 | 3.33 | 2 | 1.5 | 2 | 1.83 |
| 45 | x2 | y2 | z3 | 9 | 100 | 11 | 4 | 3 | 3 | 3.33 | 2 | 1.5 | 2 | 1.83 |
| 46 | x2 | y3 | z1 | 9 | 150 | 3 | 6 | 6 | 5 | 5.67 | 3 | 2 | 2 | 2.33 |
| 47 | x2 | y3 | z2 | 9 | 150 | 7 | 7 | 7 | 7 | 7 | 3 | 2 | 2 | 2.33 |
| 48 | x2 | y3 | z3 | 9 | 150 | 11 | 7 | 7 | 6 | 6.67 | 3 | 2 | 3 | 2.67 |
| 49 | x3 | y1 | z1 | 14 | 50 | 3 | 2 | 2 | 2 | 2 | 3 | 3 | 3 | 3 |

-continued

| Run | x | y | z | Nalco 7530 Drop | VM mL | D drop | Dispersion (G) A | D | R | Avg. | Dispersion (C) A | D | R | Avg. |
|---|---|---|---|---|---|---|---|---|---|---|---|---|---|---|
| 50 | x3 | y1 | z2 | 14 | 50 | 7 | 2 | 2 | 2 | 2 | 3 | 3 | 3 | 3 |
| 51 | x3 | y1 | z3 | 14 | 50 | 11 | 2 | 2 | 2 | 2 | 3 | 3 | 2 | 2.67 |
| 52 | x3 | y2 | z1 | 14 | 100 | 3 | 3 | 3 | 3 | 3 | 3 | 2 | 3 | 2.67 |
| 53 | x3 | y2 | z2 | 14 | 100 | 7 | 3 | 4 | 4 | 3.67 | 3 | 2 | 3 | 2.67 |
| 54 | x3 | y2 | z3 | 14 | 100 | 11 | 7 | 7 | 7 | 7 | 1 | 1 | 1 | 1 |
| 55 | x3 | y3 | z1 | 14 | 150 | 3 | 4 | 6 | 6 | 5 | 2 | 1.5 | 2 | 1.83 |
| 56 | x3 | y3 | z2 | 14 | 150 | 7 | 4 | 6 | 7 | 5.33 | 3 | 2 | 3 | 2.67 |
| 57 | x3 | y3 | z3 | 14 | 150 | 11 | | | | 7.33 | 1 | 1 | 1 | 1 |
| 58 | | #47 | | 9 | 150 | 7 t = 1 + 1 + 5 = 7 | | | | | | | | |
| 59 | | #47 | | 9 | 150 | 7 t = 1 + 1 + 18 = 20 | | | | | | | | |
| 60 | | #47 | | 9 | 150 | 7 t = 1 + 1 + 28 = 30 | | | | | | | | |
| | | | Run #61–90: 786M 1" fiber, 6.5 g fixed (81%), 1.0 g pulp fixed (91%) basis wt. = 1.68#/csf, pulp content = 15% | | | | | | | | | | | |
| 61 | x1 | y1 | z1 | 4 | 50 | 3 | 2 | 1 | 2 | 1.67 | 3 | 3 | 3 | 3 |
| 62 | x1 | y1 | z2 | 4 | 50 | 7 | 2 | 1 | 2 | 1.67 | 3 | 3 | 3 | 3 |
| 63 | x1 | y1 | z3 | 4 | 50 | 11 | 3 | 3 | 3 | 3 | 3 | 3 | 3 | 3 |
| 64 | x1 | y2 | z1 | 4 | 100 | 3 | 3 | 3 | 3 | 3 | 3 | 3 | 3 | 3 |
| 65 | x1 | y2 | z2 | 4 | 100 | 7 | 3 | 5 | 5 | 4.33 | 3 | 3 | 3 | 3 |
| 66 | x1 | y2 | z3 | 4 | 100 | 11 | 4 | 5 | 4 | 4.33 | 3 | 3 | 2 | 2.67 |
| 67 | x1 | y3 | z1 | 4 | 150 | 3 | 7 | 6 | 6 | 6.33 | 3 | 3 | 3 | 3 |
| 68 | x1 | y3 | z2 | 4 | 150 | 7 | 7 | 6 | 6 | 6.33 | 3 | 3 | 2 | 2.67 |
| 69 | x1 | y3 | z3 | 4 | 150 | 11 | 8 | 9 | 8 | 8.33 | 3 | 3 | 2 | 2.67 |
| 70 | x1 | y1 | z1 | 9 | 50 | 3 | 2 | 2 | 2 | 2 | 3 | 3 | 3 | 3 |
| 71 | x2 | y1 | x2 | 9 | 50 | 7 | 3 | 3 | 2 | 2.67 | 3 | 3 | 3 | 3 |
| 72 | x2 | y1 | z3 | 9 | 50 | 11 | 3 | 3 | 2 | 2.67 | 3 | 3 | 2 | 2.67 |
| 73 | x2 | y2 | z1 | 9 | 100 | 3 | 4 | 4 | 5 | 4.33 | 3 | 3 | 3 | 3 |
| 74 | x2 | y2 | z2 | 9 | 100 | 7 | 5 | 5 | 6 | 5.33 | 3 | 2.5 | 3 | 2.83 |
| 75 | x2 | y2 | z3 | 9 | 100 | 11 | 7 | 7 | 7 | 7 | 2 | 1.5 | 2 | 1.83 |
| 76 | x2 | y3 | z1 | 9 | 150 | 3 | 5 | 6 | 6 | 5.67 | 3 | 2.5 | 2 | 2.5 |
| 77 | x2 | y3 | z2 | 9 | 150 | 7 | 7 | 7 | 7 | 7 | 3 | 2 | 2 | 2.33 |
| 78 | x2 | y3 | z3 | 9 | 150 | 11 | 7 | 7 | 7 | 7 | 2 | 1.5 | 2 | 1.83 |
| 79 | x3 | y1 | z1 | 14 | 50 | 3 | 2 | 1 | 1 | 1.33 | 3 | 3 | 2 | 2.67 |
| 80 | x3 | y1 | z2 | 14 | 50 | 7 | 2 | 3 | 2 | 2.33 | 3 | 2.5 | 3 | 2.83 |
| 81 | x3 | y1 | z3 | 14 | 50 | 11 | 3 | 4 | 2 | 3 | 2 | 1 | 1 | 1.33 |
| 82 | x3 | y2 | z1 | 14 | 100 | 3 | 3 | 3 | 3 | 3 | 3 | 3 | 3 | 3 |
| 83 | x3 | y2 | z2 | 14 | 100 | 7 | 4 | 4 | 3 | 3.67 | 2 | 1.5 | 2 | 1.83 |
| 84 | x3 | y2 | z3 | 14 | 100 | 11 | 6 | 6.5 | 6 | 6.17 | 1 | 1 | 1 | 1 |
| 85 | x3 | y3 | z1 | 14 | 150 | 3 | 4 | 5.5 | 4 | 4.5 | 3 | 2.5 | 2 | 2.5 |
| 86 | x3 | y3 | z2 | 14 | 150 | 7 | 5 | 6.5 | 6 | 5.83 | 2 | 2 | 2 | 2 |
| 87 | x3 | y3 | z3 | 14 | 150 | 11 | 7 | 9 | 8 | 8 | 1 | 1 | 1 | 1 |
| 88 | | #69 | | 4 | 150 | 11 t = 1 + 1 + 5 = 7 | | | | | | | | |
| 89 | | #69 | | 4 | 150 | 11 t = 1 + 1 + 18 = 20 | | | | | | | | |
| 90 | | #69 | | 4 | 150 | 11 t = 1 + 1 + 28 = 30 | | | | | | | | |

Example 7

Another bicomponent mat of pulp and glass fibers was prepared. In this example both hardwood pulp and softwood pulp (e.g. Runs #16 and #20) were tested. The conditions for this example are shown on the following table. The binder used on the resulting mat was a standard UF/SBR binder. The mat was then heated in a air-conventional oven at a temperature of 475° F. to bind the materials. The procedure used was the same as Procedure I of Example 5.

The conclusion is that both soft wood and hard wood pulp can be used to make a bicomponent mat as long as the surface treatment is right.

White water history Nalco 2824 & vp532 viscosity at 1.70–1.75 added vm and raised viscosity to ~1.90. Stayed for 3 days Pulp samples:

1st 10 pulp (from ELK) samples were prepared 772 grams each pulped for 1 hour.

Fiber composition:

1. If pure glass: always 15 pounds (786 or 950s) wet;
2. If combined 950s and pulp; 13 # wet glass and 1.7 # (772g) pulp; -12%
3. If combined 786 and pulp; 13.5 # wet glass and 1.7 # (772g) pulp -12%

Dispersant always CBS; Defoamer as usual; Viscosity modifier; Nalco 2824 A="as is" ammonium at–23%; F=Nalco 7530

Pulp LOI wet sample, passing Owen twice. Then, weight and measure.

| | White water | Fiber | Pulp | Dispersant | Procedure |
|---|---|---|---|---|---|
| Starting viscosity = 1.90; Starting pH = 7.5 | | | | | |
| So, no adjustment was made. | | | | | |
| For pure fiber, the "F" was added at the 8th minute to the pulpier. | | | | | |
| 1 | 40 ml vm | 786 | None | 60 mL | |
| 2 | 40 ml vm | 786 | None | 60 mL | F = 50 mi. |
| 3 | 40 ml vm | 9502 | None | 60 mL | no F |
| 4 | 120 ml vm | 9502 | pulp + 70 ml A + 30 mL F | 60 mL | 1 |
| 5 | 120 ml vm | 788 | pulp + 70 ml A + 30 mL F | 60 mL | 1 |
| 6 | 120 ml vm | 9501 | pulp + 30 mL F (reversed) | 60 mL | 1 |
| | Visc. = 1.95 - and pH = 7.5 | | | | |
| 7 | 100 ml vm | 9502 | pulp + 70 ml A + 15 mL F (f) | 60 ml | |
| | Viscosity = ~1.90 pH = ~8.0; Note the foam is less than typical today. | | | | |
| 8 | 40 ml | 9501 | None | 60 ml | |
| 9 | 120 ml | 9502 | pulp + 70 A + 10 mL F (r) | 90 ml | 1 |
| 10 | 120 ml | 9501 | pulp + 70 A + 10 mL F (r) | 90 ml | 1 |
| | Check pH = 8 is = 1.95 plus | | | | |
| 11 | 120 ml | 9502 | pulp + 70 A + 10 mL F (r) | 90 ml | 1 |
| 12 | 120 ml | 9502 | pulp + no A + 10 ml F (r) | 90 ml | 1 |
| | Viscosity = 2.1, pH = 8.0, pulp sample prepared on | | | | |
| 13 | 40 ml | 9501 | None | 60 ml | |
| 14 | 100 ml | 9502 | pulp + 20 F (r) (No A used) | 90 ml | 1 |
| 15 | 100 ml | 9502 | pulp only | 90 ml | 1 |
| 16 | 100 ml | 9502 | 1. pulp + 20 ml F (r) | 90 ml | 1 |
| | Note: (1) this morning ALMOST NO FOAM (2) FOr #16, the 1 Paper pulp was prepared today for 30 minutes. (3) fan pump operated at 140–180 gpm (typical value is 220–260 gpm). After noon, got rid of part of WW to make the WW viscosity at ~1.85 to 1.90, pH = 8.0 | | | | |
| 17 | 100 ml | 9502 | pulp + 15 F (r) | 90 ml | 1 |
| | add 25 ml revered F into the pulper tank and re-mixed the WW. | | | | |
| 18 | 100 ml | 9502 | pulp + 15 F (r) | 90 ml | 1 |
| | Viscosity = 2.05, pH = 7.5 plus | | | | |
| 19 | 40 ml | 9501 | None | 60 ml | |
| 20 | 100 ml | 9502 | 1. pulp + __, 15 Fr (r) (15' only | 90 ml | 1 |
| 21 | 100 ml | 9502 | pulp + 7 ml F (r) | 90 ml | 1 |
| 22 | 100 ml | 9502 | pulp +0 15 ml F (r) | 90 ml | 1 |
| 23 | 40 ml | 9502 | pulp + 15 ml F (r) | 90 ml | 1 |
| 24 | 40 ml | 9501 | none | 40 ml vp 532 | |

Example 8

Another bicomponent mat was prepared. In this example, both softwood and hardwood pulp were used. In the experimental runs, the pulp was varied in type (i.e., hardwood or soft wood) and in quantity. Two different glass fibers were used and with lengths of ¾" and 1". Nalco 7530 was diluted before being added into the pulp for treatment. The specific conditions for Example 8 are shown in the following spreadsheet, procedure used was the same as Procedure I in Example 5.

FIGS. 9–14 show examples of mats formed in runs #6B, 14, 15, 17, 19, and 31 in Example 8. These examples show that by proper surface treatment, very good mats can be made by a blend of pulp fibers and glass fibers. The examples also showed that the input pulp can be either hard wood or soft wood pulp, the glass can be either type of fiber, and the fiber length can be ¾"or 1". It was noted that the fibers shorter than 3/4"would be more easier to combine with pulp fibers.

Materials: Fiberglass: 9501 ¾"; 9502 ¾"; 9502 1"; 9502 1"

Viscosity modifier: Nalco 2824

Dispersant: CBS

Pulp: Pulp I and Pulp II

Pulp I=ELK hardwood; Pulp II=I.P. softwood

Pulp soaked/agitquated in ~4.5 gal water for 45 min., the Nalco 7530 added/mixed for 5 min.

Standard binder and oven temp. (95% UF/5% latex@ 475F)

Special requirement: LOI of fibers and LOI of mat

Pulp A=620 g Pulp I+400 mL (Nalco 7530)

Pulp B=772 g Pulp I+350 (Nalco 7530) Changed from 500 mL

Pulp C=620 g Pulp II+275 mL (Nalco 7530) Changed from 400 mL

Pulp D=772 g Pulp II+350 (Nalco 7530) Changed from 500 mL

Pulp E=620 g Pulp I+275 mL (Nalco 7530) Changed from Pulp A

Pulp F=620 g Pulp I+250 mL (Nalco 7530) I picked the #

Nalco 7530 dilution: 15 mL "as is" to a total of 500 mL solution 9/8/98

270 mL Nalco 7530+8730 g water high shear mixing for 3 minute then low shear mixing for 20 minutes Pulp preparation:

soaking then mixing for 45 minutes add N7530 and mixing for 5 minutes

Old white water:

Starting conditions: viscosity=1.90, pH=8.0

| Run | | White Water | | |
|---|---|---|---|---|
| # | Glass | VM | Dispersant | Pulp |
| 1 | 11.5# ¾" 9052 | 40 mL | 60 mL | Pulp A |
| 2 | 14# 1" 9502 | 40 mL | 60 mL | Pulp A |
| | After Run #2, add 2,000 mL (PAM+) to white water and re-circulate it. | | | |
| 3 | 10.5# ¾" 9502 | 100 mL | 90 mL | Pulp A |
| 4 | 10.5# ¾" 9501 | 100 mL | 90 mL | Pulp A |
| 5 | 10.5# ¾" 9502 | 100 mL | 90 mL | Pulp A |
| 6 | 10.5# ¾" 9502 | 100 mL | 90 mL | Pulp A |
| 7 | 10.5# ¾" 9501 | 100 mL | 90 mL | Pulp A |
| 7B | 14# 1" 9502 | 40 mL | 60 mL | no |
| 6B | 10.5# ¾" 9502 | 100 mL | 90 mL | Pulp F |
| | From here on Hydropulper used for 1 min.; PAM reduced; bits disappeared. | | | |
| 8 | 13# 1" 9501 | 100 mL | 90 mL | Pulp B |
| 9 | 13# 1" 9502 | 100 mL | 90 mL | Pulp B |
| 10 | 13# 1" 9501 | 100 mL | 90 mL | Pulp B |
| 11 | 13# 1" 9502 | 100 mL | 90 mL | Pulp B |
| 12 | 10.5# ¾" 9501 | 100 mL | 90 mL | Pulp C |
| 13 | 10.5# ¾" 9502 | 100 mL | 90 mL | Pulp C |
| 14 | 10.5# ¾" 9501 | 100 mL | 90 mL | Pulp C |
| 15 | 10.5# ¾" 9502 | 100 mL | 90 mL | Pulp C |
| 16 | 13# 1" 9501 | 100 mL | 90 mL | Pulp D |
| 17 | 13# 1" 9502 | 100 mL | 90 mL | Pulp D |
| 18 | 13# 1" 9501 | 100 mL | 90 mL | Pulp D |
| 19 | 13# 1" 9502 | 100 mL | 90 mL | Pulp D |
| Dump the old white water and make fresh white water | | | | |
| Viscosity = 1.9 and pH = 8.0 | | | | |
| Spike with 500 mL PAM + before Run #20 | | | | |
| 20 | 11.5# ¾" 9502 | 40 mL | 60 mL | no |
| 21 | 14# 1" 9502 | 40 mL | 60 mL | no |
| 22 | 10.5# ¾" 9502 | 100 mL | 90 mL | Pulp E |
| 23 | 10.5# ¾" 9501 | 100 mL | 90 mL | Pulp E |
| 24 | 8.89 (4035 g) ¾" 9502 | 100 mL | 90 mL | 525 g I + 240 PAM |
| 25 | 10.5# ¾" 9501 | 100 mL | 90 mL | Pulp E |
| 26 | 13# 1" 9501 | 100 mL | 90 mL | Pulp B |
| 27 | 13# 1" 9502 | 100 mL | 90 mL | Pulp B |
| 28 | 10.5# ¾" 9501 | 100 mL | 90 mL | Pulp C |
| 29 | 8.89 (4035 g) ¾" 9502 | 100 mL | 90 mL | 525 g I + 230 PAM |
| 30 | 13# 1" 9501 | 100 mL | 90 mL | Pulp D |
| 31 | 13# 1" 9502 | 100 mL | 90 mL | Pulp D |

What is claimed is:

1. A method of making a bicomponent mat of glass fibers and wood pulp comprising the steps of:

(a) forming a pulp slurry by mixing wood pulp, water, and a cationic polymer;

(b) forming a glass fiber slurry by mixing together a dispersant, water, glass fibers, and a viscosity modifier;

(c) combining and mixing the pulp slurry and the glass fiber slurry to provide a substantially uniform fiber dispersion having a viscosity in a range of 1.5–6.0 centipoise from which is formed a wet mat having from about 5 to about 35% weight pulp solids and from about 40 to about 90% weight glass fiber solids;

(d) applying a binder to the wet met; and (e) removing any excess moisture and curing the binder.

2. The method of claim 1, wherein the wood pulp of step (a) is derived from hardwoods.

3. The method of claim 1, wherein the cationic polymer of step (a) comprises an acrylamide modified cationic polymer.

4. The method of claim 1, wherein the viscosity modifier of step (b) comprises a modified polyacrylamide.

5. The method of claim 1, wherein the dispersant of step (b) comprises a cationic or amphoteric surfactant.

6. The method of claim 5, wherein the surfactant comprises cocamidopropyl hydroxysultaine.

7. The method of claim 1, wherein the binder of step (b) is a urea formaldehyde binder.

8. The method of claim 1 wherein the glass fibers of step (b) have an average length of about 0.1 to about 1.5 inches.

9. The method of claim 1, wherein the glass fibers of step (b) have an average diameter of about 5 to about 30 microns.

10. The method of claim 1, wherein in glass fiber slurry step (b), the glass fibers are present in an amount of about 0.5 to about 3.0 weight percent of the glass fiber slurry.

11. A method of making a bicomponent mat of glass fibers and wood pulp comprising the steps of:

(a) forming a pulp slurry by mixing wood pulp, water, and a cationic polymer;

(b) forming a slurry of glass fibers by mixing a dispersant, water, glass fibers having an average fiber length of about 0.1 to about 1.5 inches, and a viscosity modifier;

(c) combining and mixing the pulp slurry and the glass fiber slurry to provide a substantially uniform fiber dispersion having a viscosity in a range of 1.5–6.0 centipoise from which is formed a wet mat wherein the pulp is present in the wet mat in an amount of about 5 to about 35 weight % of total solids, the glass fibers are present in the wet mat in an amount of about 40 to about 90 weight % of total solids, and the dispersant is present in the wet mat in an amount of about 1 weight % or less of total solids;

(d) applying a binder to the wet mat, wherein the binder is present in an amount of about 5 to about 30 weight percent of total solids; and (e) removing any excess moisture and curing the binder.

12. The method of claim 11, wherein the cationic polymer of step (a) is a acrylamide modified cationic polymer, the dispersant of step (b) comprises a cationic or amphoteric surfactant, the binder is a urea formaldehyde binder.

13. A furnish for making a bicomponent mat comprising:

(a) glass fibers having an average length of about 0.1 to about 1.5 inches;

(b) cellulosic fibrous components comprising wood pulp;

(c) a cationic polymer;

(d) a dispersant;

(e) a viscosity modifier providing a viscosity to said furnish in a range of 1.5–6.0 centipoise and (f) water;

wherein the glass fibers are present in an amount of about 40 to about 90 weight % of total solids and the wood pulp is present in the amount of about 8 to about 15 weight percent of total solids.

14. The furnish of claim 13, wherein the dispersant comprises a cationic or amphoteric surfactant.

15. The furnish of claim 13, wherein the cationic polymer comprises an acrylamide modified cationic polymer.

16. The furnish of claim 13, wherein the viscosity modifier comprises a modified polyacrylamide.

* * * * *